US010384857B2

(12) United States Patent
Presche

(10) Patent No.: US 10,384,857 B2
(45) Date of Patent: Aug. 20, 2019

(54) DISPENSING DEVICE FOR A FLUID DISPENSER

(71) Applicant: RPC Bramlage GmbH, Lohne (DE)

(72) Inventor: Martin Presche, Dinklage (DE)

(73) Assignee: RPC Bramlage GmbH, Lohne (DE)

( * ) Notice: Subject to any disclaimer, the term of this patent is extended or adjusted under 35 U.S.C. 154(b) by 0 days.

(21) Appl. No.: 15/744,154

(22) PCT Filed: Jul. 18, 2016

(86) PCT No.: PCT/EP2016/067024
§ 371 (c)(1),
(2) Date: Jan. 12, 2018

(87) PCT Pub. No.: WO2017/009481
PCT Pub. Date: Jan. 19, 2017

(65) Prior Publication Data

US 2018/0201434 A1 Jul. 19, 2018

(30) Foreign Application Priority Data

Jul. 16, 2015 (DE) ..... 10 2015 111 551

(51) Int. Cl.
*B65D 83/20* (2006.01)
*B05B 11/00* (2006.01)
*B65D 83/22* (2006.01)

(52) U.S. Cl.
CPC ..... *B65D 83/206* (2013.01); *B05B 11/3056* (2013.01); *B05B 11/3059* (2013.01); *B65D 83/22* (2013.01); *B05B 11/3052* (2013.01)

(58) Field of Classification Search
CPC .... B65D 83/22; B65D 83/206; B05B 11/3052
See application file for complete search history.

(56) References Cited

U.S. PATENT DOCUMENTS 3,141,580 A * 7/1964 Rogers ..... B65D 47/2062 222/213
3,404,814 A * 10/1968 Wakeman ..... B65D 83/206 222/213

(Continued)

FOREIGN PATENT DOCUMENTS

DE 10 2009 025 973 A1 12/2010
EP 0 282 791 A2 9/1988

(Continued)

OTHER PUBLICATIONS

International Search Report of PCT/EP2016/067024, dated Feb. 13, 2017.

*Primary Examiner* — J C Jacyna
(74) *Attorney, Agent, or Firm* — Collard & Roe, P.C.

(57) ABSTRACT

A dispensing device for a fluid dispenser has a housing, a dispensing mechanism and a dispensing nozzle which can be displaced parallel to a longitudinal extension of the dispensing device by means of the dispensing mechanism. A fluid container is connectable to the dispensing device of the fluid dispenser for the passage of fluid through the dispensing nozzle. The dispensing mechanism has an actuating handle which can be actuated substantially transversely to the longitudinal extension. The actuating handle comprises two actuating elements which are arranged opposite to one another in relation to the dispensing nozzle, wherein at least one actuating arm is assigned to each actuating element, the actuating arm extending on the inside of the actuating handle between the actuating element and an actuating surface of the dispensing nozzle, the actuating surface being formed perpendicularly to the longitudinal extension of the dispensing nozzle.

3 Claims, 13 Drawing Sheets

(56) References Cited

U.S. PATENT DOCUMENTS

| | | | | |
|---|---|---|---|---|
| 3,726,445 | A | 4/1973 | Ostrowsky et al. | |
| 6,419,124 | B1 | 7/2002 | Hennemann et al. | |
| 7,637,393 | B2 * | 12/2009 | Mineau ..... | B65D 83/206 222/162 |
| 2015/0014361 | A1 | 1/2015 | Platel | |

FOREIGN PATENT DOCUMENTS

| | | | |
|---|---|---|---|
| EP | 2 839 883 | A1 | 2/2015 |
| FR | 2 632 280 | A1 | 12/1989 |
| GB | 1 186 476 | A | 4/1970 |
| GB | 1 256 001 | A | 12/1971 |
| GB | 2 219 352 | A | 12/1989 |
| JP | H09-86574 | A | 3/1997 |
| WO | 00/07740 | A1 | 2/2000 |
| WO | 01/26995 | A1 | 4/2001 |
| WO | 2013/118074 | A1 | 8/2013 |

* cited by examiner

DISPENSING DEVICE FOR A FLUID DISPENSER

CROSS REFERENCE TO RELATED APPLICATIONS

This application is the National Stage of PCT/EP2016/067024 filed on Jul. 18, 2016, which claims priority under 35 U.S.C. § 119 of German Application No. 10 2015 111 551.4 filed on Jul. 16, 2015, the disclosures of which are incorporated by reference. The international application under PCT article 21(2) was not published in English.

FIELD OF TECHNOLOGY

The invention relates to a dispensing device for a fluid dispenser, which has a housing, a dispensing mechanism and a dispensing nozzle, which can be displaced parallel to a longitudinal extension of the dispensing device by means of the dispensing mechanism, and to which a fluid container of the fluid dispenser can be connected for the passage of fluid through the dispensing nozzle, wherein the dispensing mechanism has an actuating handle, which can be actuated substantially transversely to the longitudinal extension and the actuating movement of which is deflectable in a displacement of the dispensing nozzle counter an emptying direction, which is defined parallel to the longitudinal extension.

PRIOR ART

Dispensing devices of the above-mentioned type are known in the prior art. They are arranged in the area of a dispensing opening of a fluid container. The fluid container can for example be an aerosol can, a foam dispenser, crème dispenser or the like. The dispensing device has the dispensing mechanism, which effects a displacement of the dispensing nozzle parallel to a longitudinal extension of the dispensing device. By displacing the dispensing nozzle in the direction of the fluid container, in which the fluid to be dispensed is stored, a dispensing valve of the fluid dispenser is opened, so that fluid can be dispensed from the fluid container into the dispensing nozzle of the dispensing device and thus to the outside.

A fluid dispenser, which has a dispensing nozzle, which serves to dispense fluid and which has an axial extension and which is to be displaced in the axial direction counter the direction of the flowing fluid in order to dispense fluid, is known from EP 282 791 A2. Provision is made for an actuating handle, which can be acted upon from the outside and by means of which a pump wall can be impacted in the mentioned direction of movement of the dispensing nozzle. Due to the impact on the pump wall, the dispensing nozzle is simultaneously moved in this direction. The actuating handle is formed in the form of a button, the displacement movement of which, which is substantially at right angles to the mentioned axial direction of the dispensing nozzle, is deflected by 90 degrees so as to act upon the pump wall as mentioned. The deflection is attained by means of an angle lever, which is supported in a stationary manner.

The mentioned button is provided laterally to the dispensing nozzle. With regard to the required pump actuation, the fingers, which do not act upon the button in response to the actuation, can hold in place on the opposite side.

Based on the presented prior art, the invention deals with the task of specifying a dispensing device, which can be operated reliably.

A dispensing device, in the case of which the dispensing mechanism extends freely inside the housing, is known from DE 10 2009 025 973 A1.

With regard to the prior art, reference is to further be made to GB 1 256 001 A, GB 1 186 476 A, WO 00/07740 A1, WO 2013/118074 A1 and FR 2 632 280 A1.

SUMMARY OF THE INVENTION

This object is solved in the case of a dispensing device having a housing, a dispensing mechanism and a nozzle, wherein the dispensing mechanism further has a connecting link, by means of which the dispensing mechanism is held inside the housing (3) of the dispensing device (1), wherein the actuating elements (8) themselves have a partial area, which engages with a rotatable partial area of the housing (3) in terms of a rotationally fixed connecting link.

The dispensing mechanism is advantageous, in particular when, as preferred, the fluid dispenser, for which the dispensing device is provided, is an aerosol dispenser. The user can keep pushing down on the aerosol nozzle and a constant dispensing jet in relation to the fluid can thus be generated due to the overpressure in the aerosol container, without the hand of the user tiring immediately.

Advantageously, the actuating arms of the dispensing mechanism are mirrored relative to a plane, which has the dispensing nozzle, wherein this plane is oriented parallel to a longitudinal extension of the actuating arms in a particularly advantageous manner. In the alternative, the actuating arms of the opposite peripheral sides of the dispensing nozzle, however, can also have distances, which differ relative to the above-mentioned plane. It is only significant that a steady force on the dispensing mechanism and thus also relative to the actuating surface of the dispensing nozzle results, which reliably prevents an inclination of the actuating surface of the dispensing nozzle during an actuation of the dispensing mechanism. In this sense, it is also advisable in an advantageous manner that the dispensing device as a whole be formed symmetrically to its longitudinal extension or the dispensing nozzle, respectively, for example to have a cylindrical shape, which moreover also corresponds to the common geometric shape of fluid dispensers.

In one embodiment, each actuating element only has one actuating arm. The actuating arms of the opposite actuating elements are thereby advantageously arranged relative to the dispensing nozzle in such a way that the dispensing mechanism as a whole is point-reflected in relation to the dispensing nozzle.

According to an advantageous embodiment, two actuating arms, which, in relation to a cross section perpendicular to the longitudinal extension of the dispensing device, are arranged next to one another and on opposite peripheral sides of the dispensing nozzle, are assigned to each actuating element. In contrast to the above-mentioned simple embodiment, in the case of which each actuating element only has one actuating arm, the actuating movement of each actuating element can now be transferred simultaneously to two contact points of the actuating surface of the dispensing nozzle, whereby these contact points are advantageously arranged symmetrically to the dispensing nozzle in relation to the plane of the actuating surface. A tilt-free actuation of the dispensing mechanism is thus ensured. The actuating arms transfer the force to the actuating surface by a total of four contact points. It goes without saying that provision can thereby also be made for not only two actuating arms, but for example also three or more to be assigned to each actuating element.

It is advisable that the actuating arms have an equal distance to the dispensing nozzle. The result of this embodiment is the symmetrical arrangement of the actuating arms relative to the dispensing nozzle, so that a steady force transfer to the actuating surface is ensured.

Provision can furthermore be made for the actuating arms of an actuating element to have different distances to the dispensing nozzle and/or that an actuating arm of a first actuating element is arranged between the dispensing nozzle and an actuating arm of a second actuating element. Substantially two fundamental arrangements result thereby. According to a first arrangement, the two actuating arms of the first actuating element and the two actuating arms of the second actuating element can be arranged on the actuating elements at the same distance to one another, but can be displaced linearly in relation to a cross section perpendicular to the longitudinal extension of the dispensing device, so that, adjacent to a first peripheral side of the dispensing nozzle, an actuating arm of the first actuating element is arranged and, in relation to the opposite peripheral side of the dispensing nozzle, an actuating arm of the second actuating element is arranged. According to a second embodiment, the actuating arms can have a larger distance to one another at the first actuating element than the actuating arms on the second actuating element as an alternative. The two actuating arms of the second actuating element can thus engage between the two actuating elements of the first actuating element, so that the dispensing nozzle is adjacent only to the actuating arms of the second actuating element. Starting at the dispensing nozzle, an actuating arm of the second actuating element is thus initially arranged in relation to each of the two opposite peripheral sides of the dispensing nozzle and then an actuating arm of the first actuating element. In other words, the actuating element and the actuating arms thereof in each case form a U-shape or V-shape, the legs of which are spaced farther apart from one another in relation to the first actuating element than in relation to the second actuating element.

It is furthermore proposed that the actuating arms of opposite actuating elements overlap one another in relation to a longitudinal section through the dispensing nozzle and in the direction of a longitudinal extension of the actuating arms. The actuating arms can thus be formed to be as long as possible, so that they engage particularly far into the dispensing device and a larger lever for transferring the actuating force onto the actuating surface of the dispensing nozzle thus results. This is also advantageous, because the actuating arms are transferred from their substantially parallel arrangement to one another into an inclined arrangement by means of the actuation of the actuating handle, so that the contact points on the actuating surface are displaced.

It is furthermore proposed that the actuating elements be elastically resilient partial housing areas of the housing of the dispensing device, in particular to be formed as membrane. According to this embodiment the actuating elements are not formed as elements, which are separate from the housing, but are formed in one piece with the housing of the dispensing device, so that the dispensing mechanism is advantageously also connected to the housing of the dispensing device in one piece. The elastically resilient partial housing areas can for example be made of thermoplastic elastomers (TPE) and can be connected to the housing of the dispensing device in the context of a two-component injection molding process. A jamming of the actuating elements relative to the housing is prevented by means of the one-piece design, which is attained therewith. It is likewise also ruled out that the skin of a user is pinched between actuating element and housing in response to the actuation of the dispensing device. The penetration of dust and dirt into the dispensing device is also prevented.

It is furthermore proposed that the actuating elements protrude beyond the surrounding housing, so that a peripheral section of the actuating element has a larger distance to the dispensing nozzle than an assigned peripheral section of the housing in the same direction. In the case of this embodiment, a user of the dispensing device can recognize the actuating elements particularly easily by means of touch. The actuating elements protrude beyond the peripheral plane of the housing, so that they are displaced during the actuated state, for example into the peripheral plane of the housing. This measure increases the actuating comfort and prevents a possible pinching of a finger of the user.

It is proposed that the actuating elements be formed in one piece with the actuating arms and/or the dispensing nozzle and/or the housing, if applicable, be connected to one another by means of integral hinges. As a result of this one-piece design, the dispensing mechanism can be produced completely or at least partially in an injection molding process. It is advisable thereby to provide an integral hinge between the actuating elements and the housing, so as to provide for an actuation of the actuating elements, in particular a displacement. This is likewise also advisable with regard to a connecting area between the actuating arms and the dispensing nozzle. In contrast, elements, which do not need to have a relative mobility to one another, are advantageously injected rigidly against one another, for example the actuating elements and the actuating arms. The integral hinge is a thin material strip, at which the material can be bent without breaking. The material and the thickness of the plastic are thereby chosen such that a functionality is ensured for a long service life of the dispensing device.

With regard to or as an alternative to the above-described dispensing device, the invention further proposes that the dispensing device be capable of being displaced from a closed position, in which a displacement of the dispensing nozzle is prevented, into a dispensing position, in which a displacement of the dispensing nozzle is made possible. The dispensing device has a housing, a dispensing mechanism, and a dispensing nozzle, which can be displaced parallel to a longitudinal extension of the dispensing device by means of the dispensing mechanism, and by means of which a fluid container of the fluid dispenser can be connected for the passage of fluid through the dispensing nozzle, wherein the dispensing mechanism has an actuating handle, which can be actuated substantially transversely to the longitudinal extension and the actuating movement of which is deflectable in a displacement of the dispensing nozzle counter an emptying direction, which is defined parallel to the longitudinal extension, wherein at least a partial area of the housing can be rotated and cooperates with a rotationally fixed connecting link in such a way that the dispensing device can be displaced from a closed position, in which a displacement of the dispensing nozzle is prevented, into an open position, in which a displacement of the dispensing nozzle is made possible. According to a possible embodiment, the housing can for example be rotated relative to a rotationally fixed connecting link of the dispensing mechanism, wherein, depending on the rotational position of the housing relative to the connecting link of the dispensing mechanism, an actuation of the actuating handle is possible sometimes and sometimes not. The closed position can thereby be reached with different measures. All alternatives have in common that the actuating elements cannot be displaced in the closed position. It is possible, for example, that the actuating elements be covered by a partial area of the housing, which is pushed across the side of the actuating elements, which is directed to the outside, by means of the rotation. The actuating elements themselves furthermore also have a partial area, which engages with a rotatable partial area of the housing in terms of a rotationally fixed connecting link, so that a displacement of the actuating element is no longer possible.

It is furthermore proposed that the rotatable partial area have at least one displaceable housing element, which, in the open position, is oriented in the same rotation angle position as the actuating handle and, in the closed position, in rotation angle position, which differs from the actuating handle. According to an embodiment, a user no longer actuates the actuating elements of the actuating handle directly, but instead displaces the housing elements, which, in turn, act on the actuating elements, which are located behind them in the open position. The displacement of the actuating elements is thereby only possible, when a housing element and an actuating element are in the same rotation angle position to one another. In the closed position, the housing element and the actuating element have different rotation angle positions, so that a stationary, i.e. an immovable housing element of the housing, is pushed in front of the actuating element and an actuating of the dispensing mechanism is thus not possible.

In the alternative, provision can be made for the housing to have a first partial housing area and a second partial housing area, which can be rotated relative to one another such that in the closed position, a locked partial area of the first partial housing area cooperates with a locked partial area of the second partial housing area. A first partial housing area can for example be a peripheral surface of the housing, while a second partial housing area is a frontal cover element of the housing. According to an embodiment, for example an actuation of an actuating element, which is arranged on the peripheral surface, is prevented.

Advantageously, the housing and the connecting link have corresponding collision elements, which are formed to generate a collision noise as a function of a defined rotational movement of the housing relative to the connecting link. The housing and the stationary connecting link of the dispensing mechanism can have ribs, for example, which generate a clicking noise, which signals the opening or closing, respectively, of the dispensing device to a user of the dispensing device in response to a rotation of the housing relative to the connecting link. Provision can furthermore be made between the housing and the connecting link for end stops, which prevent a rotation of the housing beyond the closed position or, in opposition direction, beyond the open position, respectively.

The connecting link can furthermore be formed in one piece with the actuating handle and/or the dispensing nozzle. Provided that the connecting link is a connecting link of the dispensing mechanism, for example, it is advantageously connected to the actuating element via an integral hinge. The dispensing nozzle can also be formed in one piece with the connecting link, for example injection molded thereto. Provided that the connecting link is a connecting link of the housing, a rotationally fixed partial area of the housing can include the dispensing mechanism and the dispensing nozzle, for example in one piece, while a second partial housing area is rotatable.

Lastly, the invention proposes a further embodiment of the dispensing device, which in particular provides for a quick and cost-efficient production. A dispensing device for a fluid dispenser is proposed, in particular an above-described dispensing device, which has a housing, a dispensing mechanism and a dispensing nozzle, which can be displaced parallel to a longitudinal extension of the dispensing device by means of the dispensing mechanism, and to which a fluid container of the fluid dispenser can be connected for the passage of fluid through the dispensing nozzle, wherein the dispensing mechanism has an actuating handle, which can be actuated substantially transversely to the longitudinal extension and the actuating movement of which is deflectable in a displacement of the dispensing nozzle counter an emptying direction, which is defined parallel to the longitudinal extension, wherein the actuating handle has two actuating elements, which are arranged opposite to one another in relation to the dispensing nozzle and which are connected to actuating arms of the dispensing mechanism in one piece, said actuating arms being formed in one piece with the dispensing nozzle, wherein the actuating elements and the actuating arms are arranged in a substantially M-shaped manner in relation to a longitudinal section through a plane spanned by the actuating arms. According to this embodiment, the actuating elements are connected to the actuating arms, the dispensing nozzle and advantageously also to the housing of the dispensing device in one piece. The dispensing device as a whole can thus be produced in the context of an injection molding process, which provides for a particularly quick and cost-efficient production. Provision is thereby advantageously made between an actuating element and an actuating arm and/or an actuating arm and the dispensing nozzle for an elastically resilient area, which makes it possible to displace the actuating element relative to the remaining housing areas and thus also to displace the dispensing nozzle in the longitudinal extension of the dispensing device.

It is proposed that an actuating arm have an impact section and a connecting section, wherein the connecting section is connected to the impact section as well as to the actuating element in an articulated manner. The impact section thereby identifies an actuating surface of the dispensing nozzle, to which a force is applied to displace the dispensing nozzle. The connecting section substantially connects this impact section to the actuating element. The actuating movement can be transferred into a displacement of the dispensing nozzle by means of the articulated connecting areas, in particular integral hinges.

It is furthermore proposed that the actuating section be obstructed from moving transversely to the displacement direction of the dispensing nozzle, so as to provide for a setup movement of the connecting section in the course of the actuation of the actuating handle. The movement obstruction transversely to the displacement direction thereby advantageously occurs via a rigid connection of the dispensing nozzle to the actuating section. A movability of the dispensing mechanism is provided exclusively in the connecting areas between the impact section and the connecting section or the connecting section and the actuating element, respectively, so that a displacement of the actuating element, which is directed transversely to the longitudinal extension of the dispensing device, effects a setup of the connecting section, which setup movement, in turn, effects a displacement of the impact section and thus also of the dispensing nozzle in the direction of the fluid dispenser. This movement is guided to the impact section by means of the rigid connection of the dispensing nozzle, so that only a movement in the longitudinal extension is possible.

As an alternative to the formation of a connecting section, which is connected to the impact section as well as to the actuating element in an articulated manner, the invention proposes an embodiment, in the case of which an actuating arm of the dispensing device has a curved elastically resilient impact section and a connecting section, wherein the impact section is arranged between the connecting section and the dispensing nozzle. According to this embodiment, the actuating arm is rigidly connected to the actuating element of the dispensing mechanism. A pivoting of the actuating element and thus also of the connecting section effects a setup movement of the impact section, which, due to its arc shape, which is curved in the direction of the fluid container, exerts a force on the dispensing nozzle, which acts in the direction of the fluid container. The pivotability of the connecting section relative to the impact section is thereby made possible by means of an elastically resilient area, in particular an integral hinge.

BRIEF DESCRIPTION OF THE DRAWINGS

The invention will be described in more detail below by means of exemplary embodiments.

DESCRIPTION OF THE EMBODIMENTS

Figure 1:
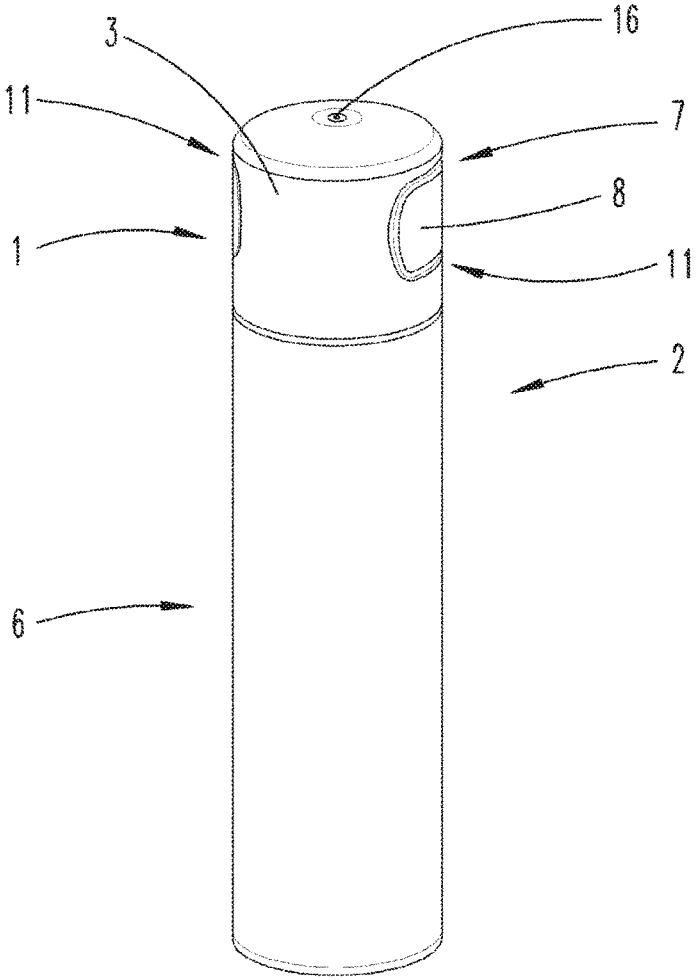
FIG. 1 shows a dispensing device in a perspective view.

FIG. 1 shows a fluid dispenser 2 comprising a fluid container 6 and a dispensing device 1 arranged thereon. The fluid container 6 is formed for example as aerosol can here. The dispensing device 1 is pressed onto the fluid container 6. The fluid container 6 as well as the dispensing device 1 are formed cylindrically.

The dispensing device 1 has a housing 3 comprising a frontal dispensing opening 16 for dispensing a fluid conveyed from the fluid container 6. An actuating handle 7 comprising two actuating elements 8 here is arranged on the peripheral surface of the dispensing device 1. The actuating elements 8 are inserted into corresponding recesses (partial housing areas 11) of the housing 3 of the dispensing device 1. The actuating elements 8 are substantially flush with the peripheral plane of the housing 3.

Figure 2:
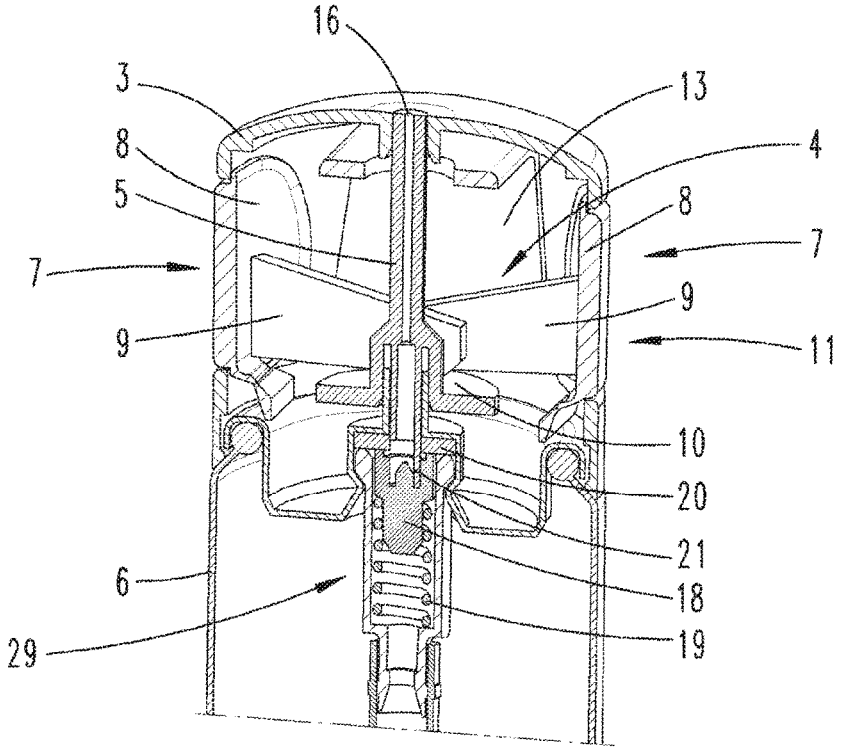
FIG. 2 shows a dispensing device according to a first embodiment (not an embodiment according to the invention) in a longitudinal section in a non-actuated position.

FIG. 2 shows the dispensing device 1 and an upper partial area of the fluid container 6, at which the dispensing device 1 is arranged. The dispensing device 1 has a dispensing mechanism 4, which is located inside the housing 3 of the dispensing device 1. The dispensing mechanism 4 has the actuating handle 7 with the two actuating elements 8. Two actuating arms 9 are in each case assigned to each actuating element 8. The actuating elements 9 are immovably arranged on the actuating element 8. The actuating arms 9 in each case extend inside the housing 3 between the actuating element 8 and a dispensing nozzle 5, which guides a fluid from the fluid container 6 to the dispensing opening 16 of the housing 3 of the dispensing device 1. The dispensing nozzle 5 is arranged parallel to a longitudinal extension of the dispensing device 1, i.e. the longitudinal axis of the cylinder here, so as to be displaceable inside the dispensing device 1. The end areas of the actuating arms 9 located opposite the actuating elements 8 bear on an actuating surface 10 of the dispensing nozzle 5, so that a displacement of the actuating arms 9 can be transferred into a displacement of the dispensing nozzle 5. The dispensing mechanism 4 furthermore has a connecting link 13, by means of which the dispensing mechanism 4 is held inside the housing 3 of the dispensing device 1. The housing 3 has the partial housing areas 11, through which the actuating elements 8 engage for actuation by a user of the fluid dispenser 2.

The fluid container 6 has a valve 29, which can be actuated by means of the dispensing device 1. In the usual manner, the valve 29 has a piston 18 here, which can be displaced parallel to the longitudinal extension of the dispensing device 1 and which can be displaced from an illustrated locked position into a passage position against the force of a spring 19. A sealing element 20 is arranged between the piston 18 and a cylinder wall of the valve 29, against which sealing element the piston 18 abuts in the locked position and to which the piston 18 has a distance in the passage position, so that fluid can flow from the fluid container 6 through the spring 19 and into the dispensing nozzle 5 between the piston 18 and the sealing element 20. To actuate the piston 18, a tappet 21 is arranged on the dispensing nozzle 5, which tappet effects a displacement of the piston 18 into the passage position as a result of a displacement of the dispensing nozzle 5 in the direction of the fluid container 6.

Figure 3:
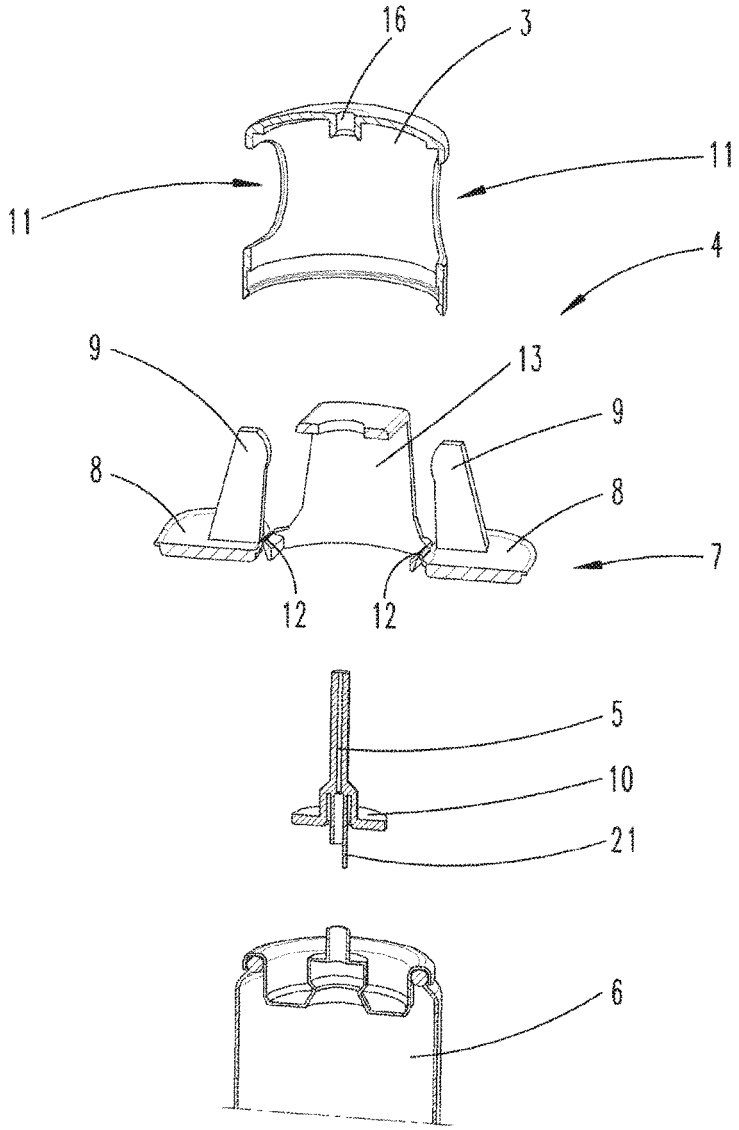
FIG. 3 shows the dispensing device according to FIG. 2 in an exploded illustration.

FIG. 3 shows the dispensing device 1 in an exploded illustration as well as the upper part of the fluid container 6, to which the dispensing device 1 can be connected. The housing 3 comprising the dispensing opening 16 as well as the partial housing areas 11 for guide-through of the actuating elements 8 of the dispensing mechanism 4, is illustrated. The dispensing mechanism 4 illustrated therebelow has a connecting link 13, which can be arranged on the inner wall of the housing 3 in a shape-corresponding manner. Here, the connecting link 13 is connected to the actuating elements 8 via integral hinges 12 in an exemplary manner, wherein the actuating elements 8 are located on opposite sides of the dispensing mechanism 4. The actuating elements 8 are pivotable relative to the connecting link 13 by means of the integral hinges 12. One actuating arm 9 is in each case arranged on each actuating element 8. The illustration shows the state of the dispensing mechanism 4 immediately after the production thereof. Advantageously, the dispensing mechanism 4 is made of a plastic, which can be processed in the injection molding process. The actuating elements 8 are pivoted relative to the connecting link 13 only for arranging the shown dispensing mechanism 4 inside the housing 3 of the dispensing device 1, so that the actuating arms 9 are substantially oriented towards one another. Here, the dispensing nozzle 5 is formed as separate component in an exemplary manner. They can, however, also be integrally molded to the dispensing mechanism 4 in one piece and so as to be capable of being displaced. The dispensing nozzle 5 has a substantially annular actuating surface 10 for attaching the free end areas of the actuating arms 9 as well as the tappet 21 for opening the valves 29 of the fluid container 6.

Figure 4:
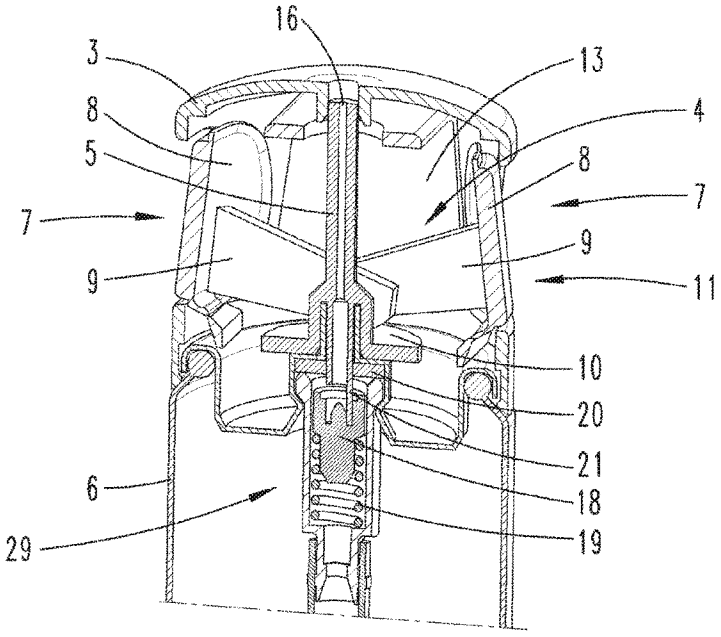
FIG. 4 shows the dispensing device according to FIG. 2 in an actuated position.

FIG. 4 shows the dispensing device 1 according to FIG. 2 in an open state. The actuating elements 8 are thereby pivoted into the housing 3 of the dispensing device 1, whereby the actuating arms 9 are simultaneously also pivoted and the dispensing nozzle 5 is pressed across the actuating surface 10 in the direction of the fluid container 6. The valve 29 of the fluid container 6 is thus shifted into the open position, wherein the piston 18 is spaced apart from the sealing element 20 and the fluid can be dispensed from the fluid container 6 into the dispensing device 1 and through the dispensing opening 16 into the environment.

Figure 5:
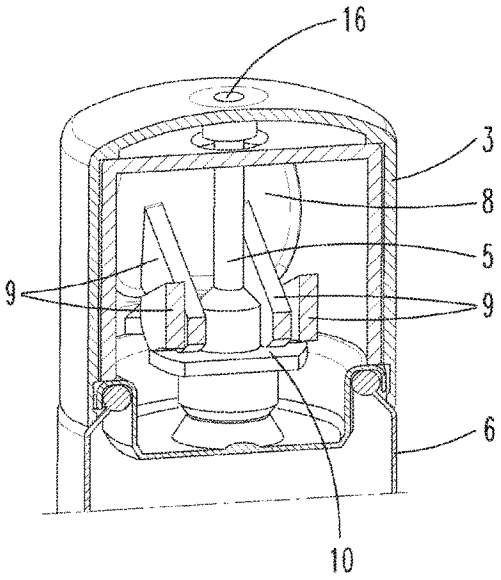
FIG. 5 shows the dispensing device according to FIG. 2 in a longitudinal section rotated by 90 degrees.

FIG. 5 shows a view of the dispensing device 1, which is rotated by 90 degrees. In this illustration, the dispensing device 1 is cut perpendicular to the longitudinal extension of the actuating arms 9. Two actuating arms 9, which, with their free end area, bear on the actuating surface 10 on opposite peripheral sides of the dispensing nozzle 5, are in each case arranged at each of the two actuating elements 8. The actuating arms 9 of a first actuating element 8 are thereby arranged closer to the dispensing nozzle 5 than the actuating arms 9 of a second actuating element 8. Both actuating arms 9 of the respective actuating element 8 are arranged at the same distance to the dispensing nozzle 5, so that the force, which acts on the actuating surface 10 by means of the actuating arms 9, is distributed substantially symmetrically to the dispensing nozzle 5. In the case of the embodiment shown here, the dispensing mechanism 4 is mirror-symmetrically to a plane, which runs through the dispensing nozzle 5 and which is oriented parallel to the actuating arms 9.

The invention according to this embodiment works in such a way that a user actuates the dispensing device 1, which is connected to the fluid container 6, for dispensing fluid from the fluid container 6. For this purpose, the user pushes the actuating elements 8 of the actuating handle 7, which protrude through the housing 3 of the dispensing device 1, into the housing 3. The actuating elements 8 are thus pivoted about the integral hinges 12, wherein the actuating arms 9, which are fastened to the actuating elements 8, are tilted and are displaced downwards inside the dispensing device 1, i.e. in the direction of the fluid container 6, with their free end areas. The free end areas act on the actuating surface 10 of the dispensing nozzle 5, whereby the latter is also displaced in the direction of the fluid container 6. The tappet 21, which is arranged on the dispensing nozzle 5, actuates the valve 29, which is arranged inside the fluid container 6. Said valve is moved into an open position, so that fluid reaches from the fluid container through the dispensing nozzle 5 to the dispensing opening 16 and can be carried to the outside from there. To end the dispensing of fluid, the user ends the actuation of the actuating elements 8. The spring 19 of the valve 29 can thus displace the dispensing mechanism 4 back into the closed position of the dispensing device 1 again. In this position, the valve 29 is closed again and the actuating elements 8 are located substantially in the peripheral plane of the housing 3 of the dispensing device 1 and are thus available for an actuation again.

FIGS. 6 to 13 show a second embodiment of the invention, in the case of which the housing 3 of the dispensing device 1 can be rotated relative to the connecting link 13 and the dispensing mechanism 4. The housing 3 is thereby rotatably supported on the connecting link 13 of the dispensing device 1, so that the dispensing device 1 can be displaced from a closed position, in which a displacement of the dispensing nozzle 5 is prevented, into an open position, in which a displacement of the dispensing nozzle 5 is made possible. The displacement of the dispensing nozzle 5 and thus also the output of fluid from the fluid container 6, is prevented in that the actuating elements 8 are rotated out of the partial housing areas 11, with which the actuating elements 8 engage during the open position of the dispensing device 1, by means of a rotation of the housing 3 about the dispensing mechanism 4. So that the actuating elements 8 do not make it possible to view the dispensing mechanism 4 during the closed position, the housing 3 of the dispensing device 1 in the partial housing areas 11 has pivotable housing elements 14, which can be pivoted into the dispensing device 1 analogously to the actuating elements 8 of the dispensing mechanism 4.

The connecting link 13, which is connected to the dispensing mechanism 4 in one piece, has a partial locking part 26, which engages with a corresponding groove 28 of the housing 3, which is formed along the periphery of the housing 3 in a annular manner. When the partial locking area 26 reaches into the partial housing areas 11 by means of the rotation of the housing 3 about the dispensing mechanism 4, the pivoting of housing elements 14 of the housing 3 to the inside is prevented, because the housing elements 14 only act against the partial locking areas 26 of the connecting link 13 in response to a displacement, but not against the actuating elements 8, which are unscrewed from the partial housing areas 11. When the user now transfers the housing 3 from the closed position into the open position, i.e. rotates the housing 3 relative to the dispensing mechanism 4 about such an angle of rotation that the actuating elements 8 are located upstream of the pivotable housing element 14 of the housing 3 again, the housing elements 14 and thus also the actuating elements 8 can be pivoted inwards into the dispensing device 1, and, as already described above, can effect the displacement of the dispensing nozzle 5.

Figure 7:
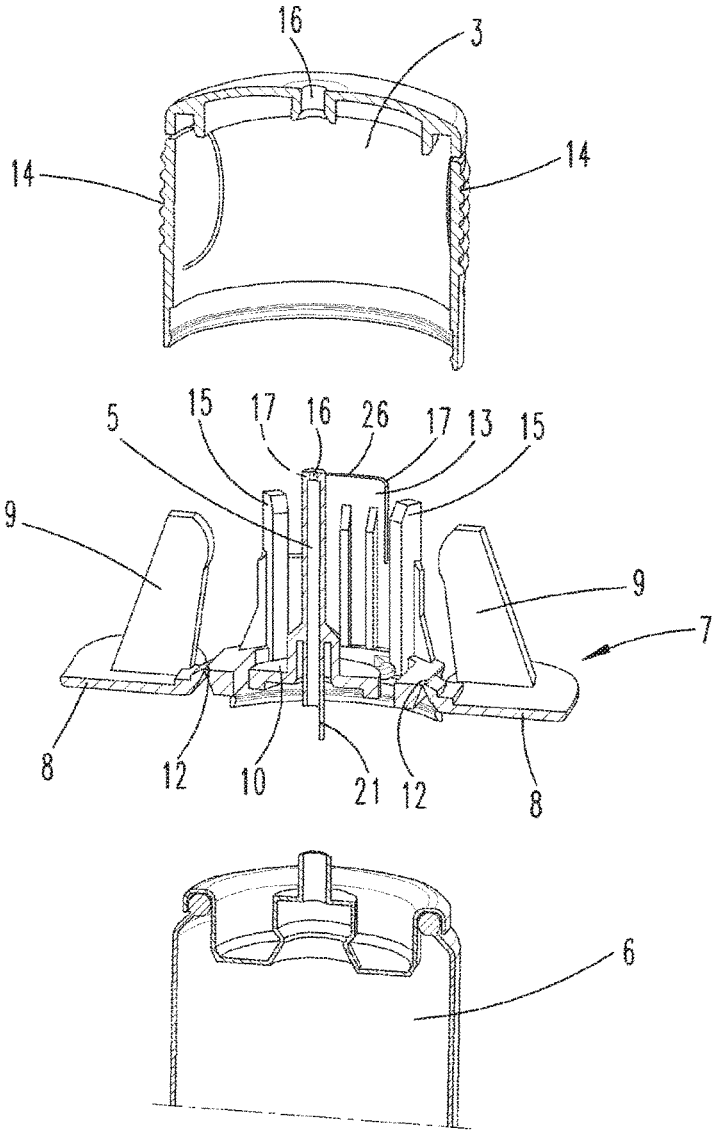
FIG. 7 shows the dispensing device according to FIG. 6 in an exploded illustration.

FIG. 7 shows the housing 3 and connecting link 13 comprising the dispensing mechanism 4. The connecting link 13, the dispensing mechanism 4, including the actuating handle 7 and the actuating arms 9 as well as the dispensing nozzle 5 are formed as a one-piece plastic injection molded part. Integral hinges 12, which provide for a pivoting of the actuating elements 8, are arranged between the connecting link 13 and the actuating elements 8. The dispensing nozzle 5 is arranged on an elastically deformable partial area of the connecting link 13, so that the dispensing nozzle 5 can be displaced relative to the connecting link 13 in response to a pressure of the actuating arms 9 onto the actuating surface 10 of the dispensing nozzle 5. To indicate to a user of the dispensing device 1 that the closed position or open position has been reached, respectively, during the rotation of the housing 3 about the dispensing mechanism 4, the connecting link 13 has collision elements 15, which cooperate with corresponding connecting elements 15 of the housing 3 (see FIG. 11). In response to a rotation of the housing 3 about the dispensing mechanism 4, the collision elements 15 of the housing 3 pass along the collision elements 15 of the connecting link 13, which causes a clicking noise, which signals an imminent reaching of the open position or closed position, respectively, to the user. Provided that the user then further rotates the housing 3, end stops 17 formed on the partial locking area 26 of the connecting link 13 come into contact with the collision elements 15 of the housing 3. The collision elements 15 of the housing 3 are not able to move past the end stops 17 of the partial locking area 26, so that a further rotation of the housing 3 about the dispensing mechanism 4 is prevented. The open position or closed position, respectively, is thus reached. To once again get from the open position into the closed position, or to reach the open position, starting at the closed position, respectively, the user needs to rotate the housing 3 in the opposite direction.

Figure 6:
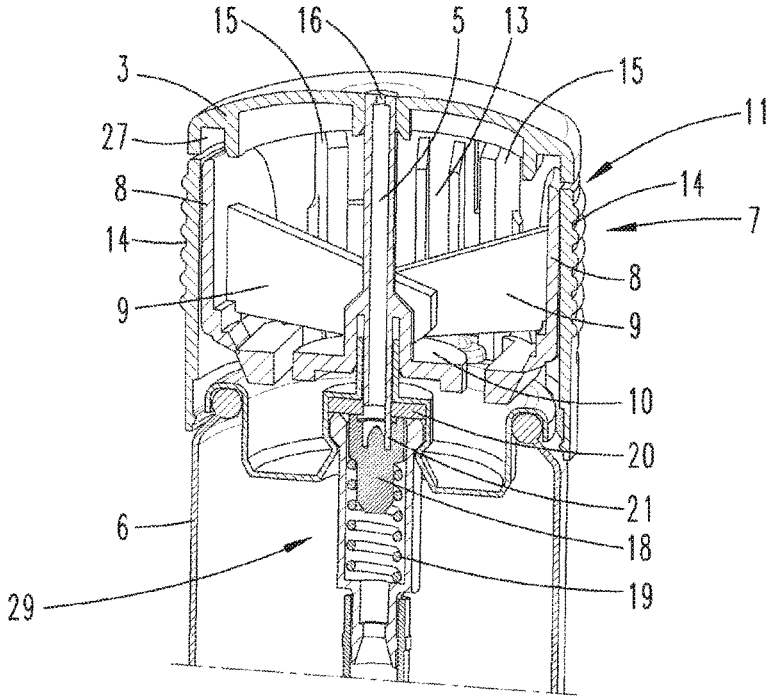
FIG. 6 shows a dispensing device according to a second embodiment (not an embodiment according to the invention) in a longitudinal section (open position)
Figure 8:
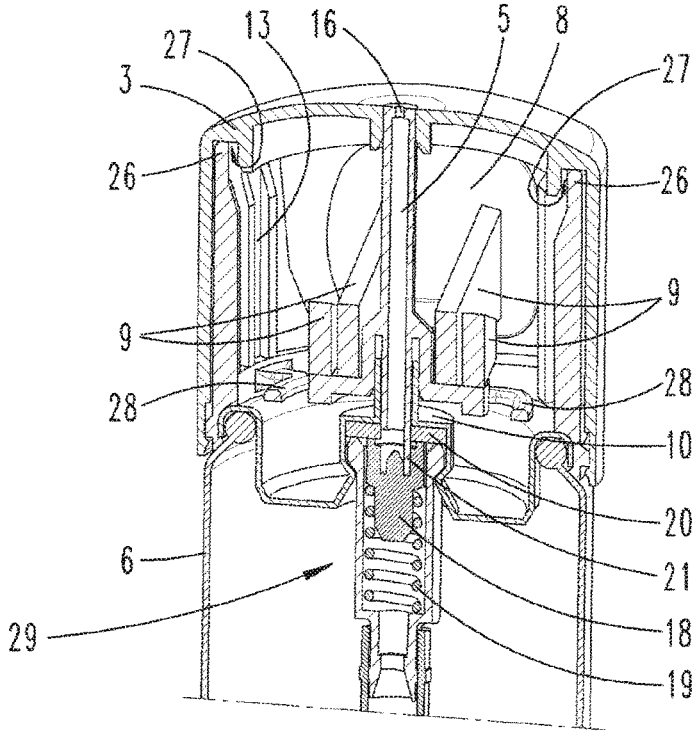
FIG. 8 shows the dispensing device according to FIG. 6 in a longitudinal section rotated by 90 degrees.

FIG. 8 shows the dispensing device 1 according to FIG. 6 in a view rotated by 90 degrees. It can be seen here that the partial locking area 26 of the connecting link 13 engages with the partial locking area 27 of the housing 3, but not in the area of the housing element 14, behind which the actuating elements 8 are currently arranged. The housing elements 14 and the actuating elements 8 can thus be pivoted.

Figure 9:
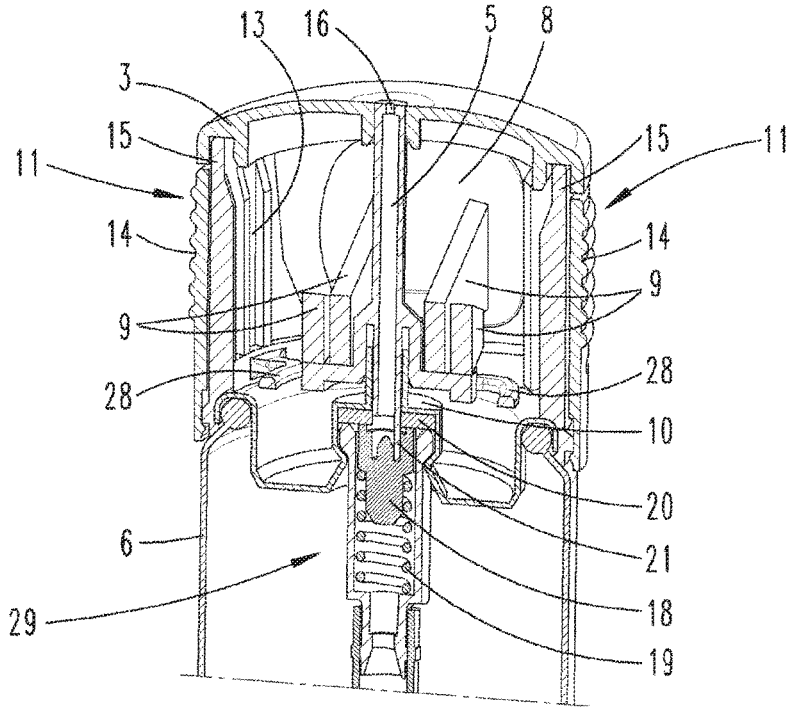
FIG. 9 shows the dispensing device according to FIG. 6 in a closed position.

In contrast, FIG. 9 shows the closed position of the dispensing device 1, in which the partial locking area 26 of the connecting link 13 is rotated into the area of the housing elements 14, so that a pivoting of the housing elements 14 is prevented. The actuating elements 8 are located in a partial peripheral area of the housing 3, which does not have a housing element 14 for actuating the actuating elements 8.

Figure 10:
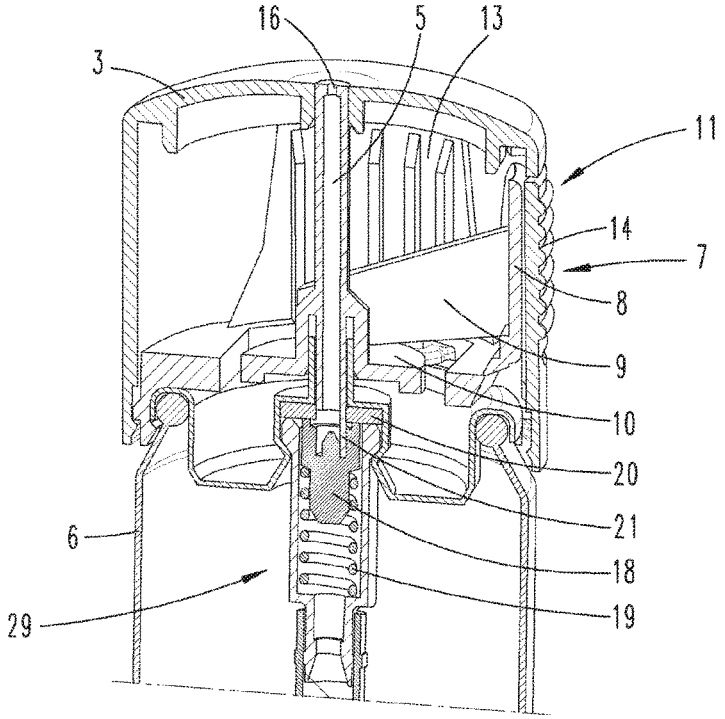
FIG. 10 shows a modification of the dispensing device according to FIG. 6 with only one actuating element.

FIG. 10 shows a modification of the dispensing device 1, in the case of which the actuating handle 7 only has one actuating element 8 and only one actuating arm 9. This results in an asymmetrical construction of the dispensing device 1.

Figure 11:
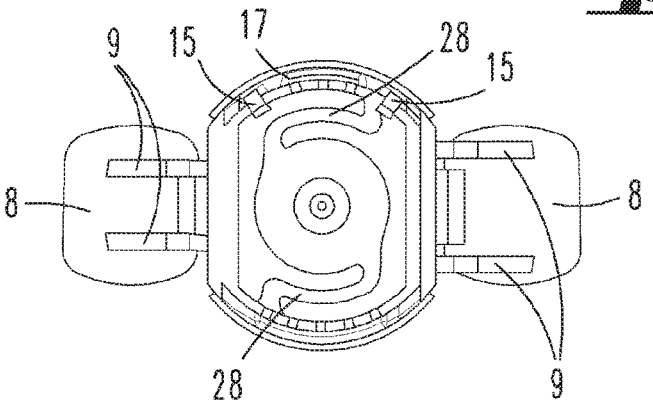
FIG. 11 shows a dispensing mechanism of the dispensing device according to FIG. 6 in a top view.

FIG. 11 shows the dispensing mechanism 4 illustrated in FIG. 7, the connecting link 13 as well as the dispensing nozzle 5 in a view from the top. The dispensing nozzle 5 is connected to the connecting link 13 in one piece via movable arms 28, wherein a displacement of the dispensing nozzle 5 parallel to the longitudinal extension of the dispensing device 1 is possible due to an elastically deformable embodiment of the arms 28.

Figure 12:
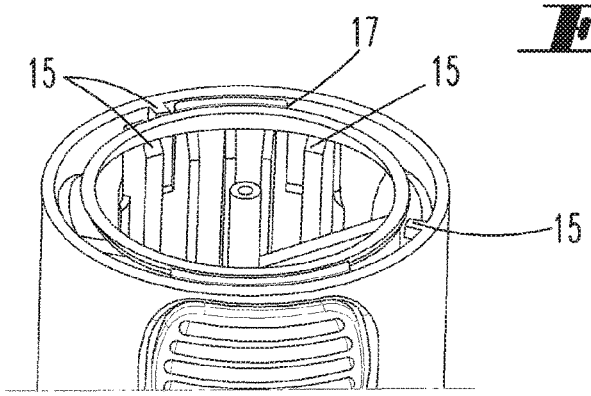
FIG. 12 shows the dispensing device according to FIG. 6 in a perspective cross section.

FIG. 12 shows a perspective cross section trough the dispensing device 1. The section is located in the area of the partial locking area 27, which is formed on the housing 3. The collision elements 15 of the housing 3, which are formed for cooperating with the collision elements 15 of the connecting link 13 or the end stops 7 of the partial locking area 26 of the connecting link 13, respectively, can be seen.

Figure 13:
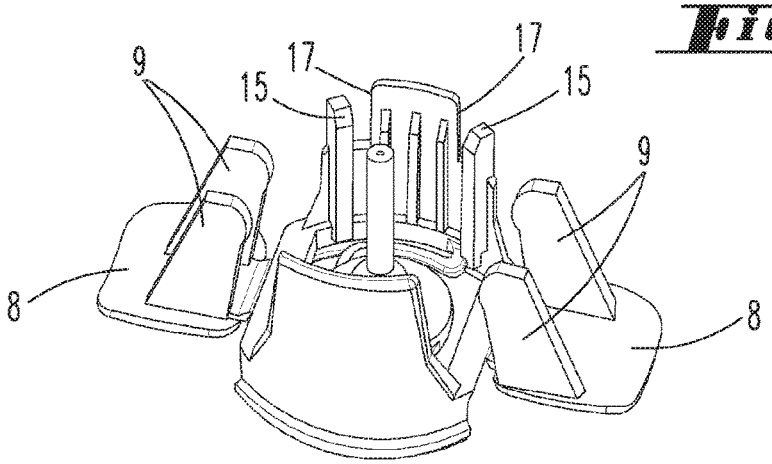
FIG. 13 shows the dispensing mechanism according to FIG. 11 in a perspective view.

FIG. 13 shows a perspective view of the dispensing mechanism 4, of the connecting link 13 as well as of the dispensing nozzle 5 according to FIG. 11.

Figure 15:
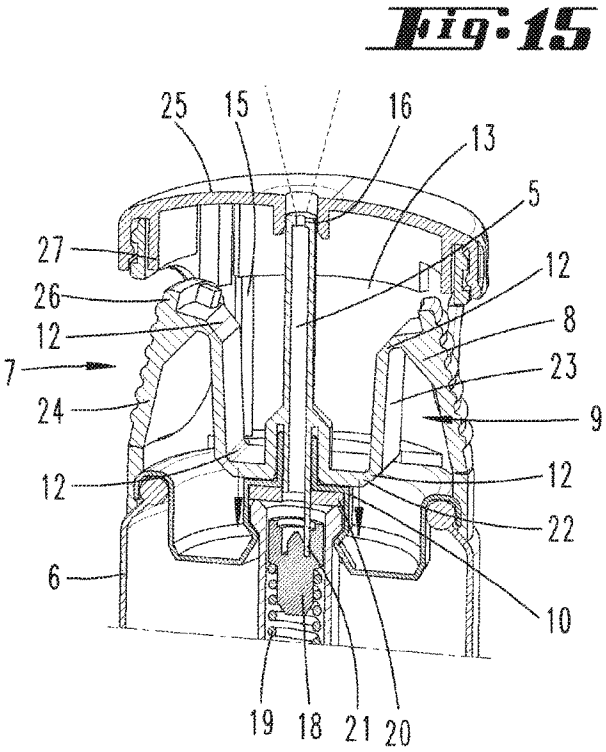
FIG. 15 shows the dispensing device according to FIG. 14 in an actuated position.
Figure 14:
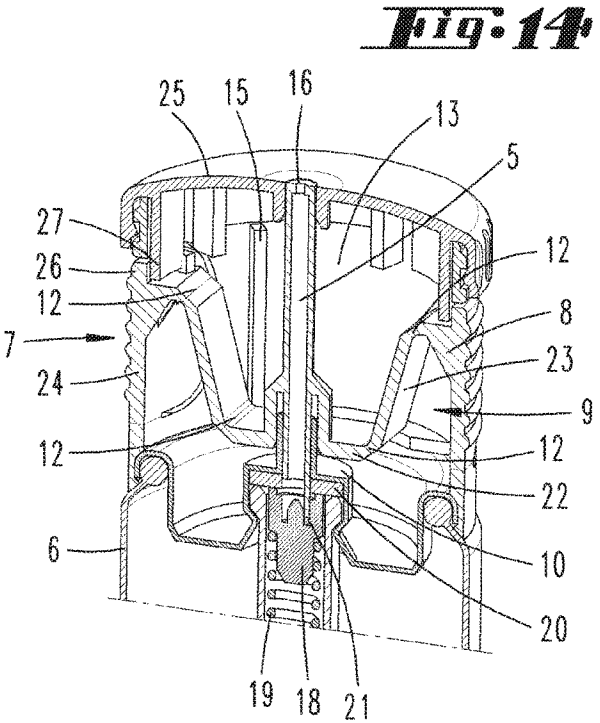
FIG. 14 shows a dispensing device according to a third embodiment (not an embodiment according to the invention) in a longitudinal section in a non-actuated position.

Lastly, FIGS. 14 to 18 show a third embodiment of the invention, in the case of which the housing 3 has a first partial housing area 24 and a second partial housing area 25. The first partial housing area 24 is connected to the fluid container 6 in a rotationally fixed manner, while the second partial housing area 25 is rotatably arranged on the first partial housing area 24. The first partial housing area 24, the dispensing mechanism 4, the dispensing nozzle 5, and the connecting link 13 are formed in one piece. At the same time, the actuating elements 8 are thereby pivotable partial areas of the housing 3. The actuating arms 9 are formed with these actuating elements 8 and the dispensing nozzle 5 in one piece, wherein each actuating arm 9 has an impact section 22 and a connecting section 23. The connecting section 23 is connected to the impact section 22 as well as to the actuating element 8 in an articulated manner by means of an integral hinge 12. The impact section 23 simultaneously forms the actuating surface 10 of the dispensing nozzle 5 and is obstructed from moving transversely to the displacement direction of the dispensing nozzle 5, but can be displaced in the direction of the fluid container 6, so that the displacement of the impact section 22 simultaneously requires a displacement of the dispensing nozzle 5. In the course of an actuation of the actuating element 8 of the housing 3, the connecting section 23 is set up, so that it occupies a smaller angle relative to the longitudinal extension of the dispensing nozzle 5. This setup is made possible by the elastic formation of the integral hinges 12 in the area between the connecting section 23 and the actuating element 8 or the impact section 22 and the connecting section 23, respectively. As a result of the setup of the connecting section 23, a force is simultaneously exerted on the impact section 22, which results in a displacement of the dispensing nozzle 5 in the direction of the fluid container 6. As described above, this displacement effects an actuation of the valve 29 into the open position, so that fluid can flow from the fluid container 6 into the dispensing nozzle 5. The open position of the dispensing device 1 is illustrated in FIG. 15.

Figure 16:
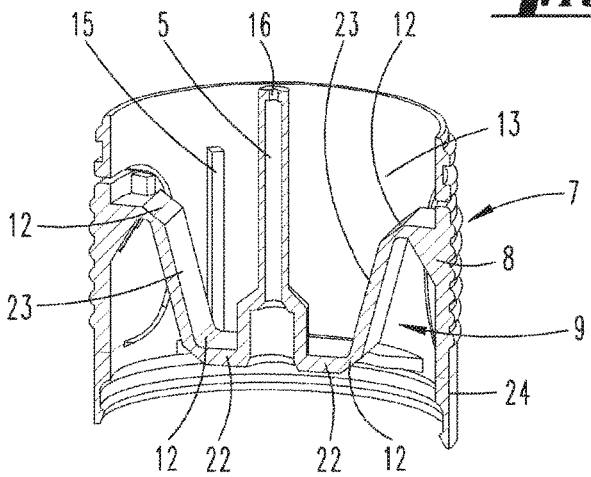
FIG. 16 shows the detailed view of a dispensing mechanism of the dispensing device according to FIG. 14.
Figure 17:
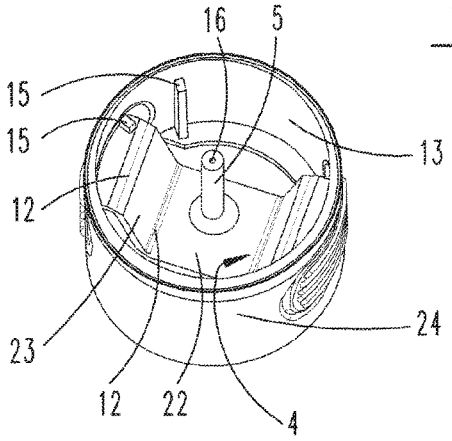
FIG. 17 shows a first partial housing area of the dispensing device according to FIG. 14.
Figure 18:
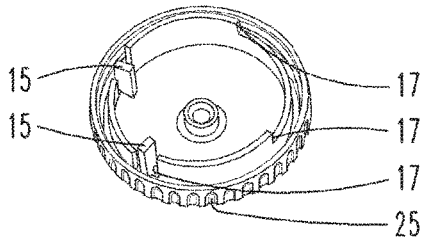
FIG. 18 shows a second partial housing area of the dispensing device according to FIG. 14.

FIG. 16 shows a detailed view of the housing 3, including the dispensing mechanism 4, connecting link 13 and dispensing nozzle 5, which are formed therewith in one piece. FIGS. 17 and 18 show perspective views of the first partial housing area 24 or of the second partial housing area 25, respectively, The collision elements 15 and end stops 17 of the second partial housing 25 can be seen, which cooperate with the collision elements 15 of the first partial housing area 24 as described above.

Figure 19:
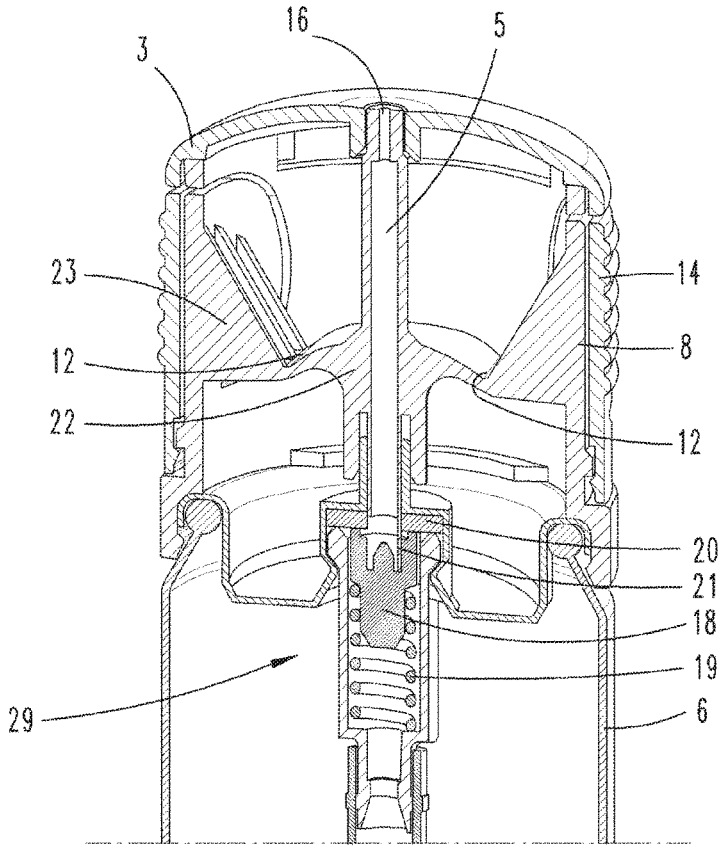
FIG. 19 shows a dispensing device according to a fourth embodiment in a longitudinal section.

FIG. 19 shows a fourth embodiment of a dispensing device 1, in the case of which the actuating elements 8, the actuating arms 9 and the dispensing nozzle 5 are embodied in one piece. Here, the actuating arms 9 have a curved elastically resilient impact section 22 as well as a connecting section 23, which is formed in a rigid and one-piece design with the actuating element 8. The curved impact section 22 is arranged between the connecting section 23 and the dispensing nozzle 5. An integral hinge 12, which provides for a pivoting of the connecting section 23 relative to the impact section 22 or vice versa, respectively, is furthermore arranged between the rigid connecting section 23 and the elastically resilient impact section 22. The impact section 22 is curved in the direction of the fluid container 6, i.e. the apex of the curve points in a direction, which faces away from the fluid container 6. In response to an actuation of the actuating elements 8 or of the housing elements 14, respectively, the connecting sections 23 of the actuating arms 9 are pivoted in a direction towards the dispensing nozzle 5. By pivoting the connecting section 23, the partial area of the impact section 22, which is arranged on the connecting section 23, is pushed in the direction of the dispensing nozzle 5, so that a setup movement of the impact section 22 takes place. The setup movement is supported by the integral hinge 12, which is arranged between the impact section 22 and the connecting section 23. As a result of the setup movement of the impact section 22, a force is exerted on the dispensing nozzle 5 in the direction of the fluid container 6, so that the dispensing nozzle 5 is displaced in the direction of the fluid container 6, and the valve 29 is opened for dispensing a fluid from the fluid container 6 into the dispensing nozzle 5.

In particular and preferably, the fluid container 6 is an aerosol container. It contains a fluid, in particular a liquid, which is pressurized due to an overpressure of a gas blanket, which is further provided inside the fluid container. In response to the actuation of the valve 29, a constant fluid flow thus escapes as long as a pressure, which displaces the valve into the open position, is exerted via the actuating elements.

LIST OF REFERENCE NUMERALS

1 dispensing device 29 valve
2 fluid dispenser
3 housing
4 dispensing mechanism
5 dispensing nozzle
6 fluid container
7 actuating handle
8 actuating element
9 actuating arm
10 actuating surface
11 partial housing area
12 integral hinge
13 connecting link
14 housing element
15 collision element
16 dispensing opening
17 end stop
18 piston
19 spring
20 sealing element
21 tappet
22 impact section
23 connecting section
24 first partial housing area
25 second partial housing area
26 partial locking area
27 partial locking area
28 arm

The invention claimed is:

1. A dispensing device for a fluid dispenser, which has a housing, a dispensing mechanism and a dispensing nozzle, which can be displaced parallel to a longitudinal extension of the dispensing device by means of the dispensing mechanism, and to which a fluid container of the fluid dispenser can be connected for the passage of fluid through the dispensing nozzle, wherein the dispensing mechanism has an actuating handle, which can be actuated substantially transversely to the longitudinal extension and the actuating movement of which is deflectable in a displacement of the dispensing nozzle counter an emptying direction, which is defined parallel to the longitudinal extension, wherein the actuating handle further has two actuating elements, which are arranged opposite to one another in relation to the dispensing nozzle and which are connected to actuating arms of the dispensing mechanism in one piece, said actuating arms being formed in one piece with the dispensing nozzle, wherein the actuating elements and the actuating arms are arranged in a substantially M-shaped manner in relation to a longitudinal section through a plane spanned by the actuating arms, wherein an actuating arm has a curved elastically resilient impact section and a connecting section, wherein the impact section is arranged between the connecting section and the dispensing nozzle, and wherein the impact section is curved in the direction of the fluid container such that an apex of the curve faces away from the fluid container, and the impact section is connected to the connecting section by means of an elastically resilient area, so as to provide for a setup movement of the impact section in the course of the actuation of the actuating handle.

2. The dispensing device according to claim 1, wherein the actuating elements are elastically resilient partial housing areas of the housing of the dispensing device, in particular are formed as membrane.

3. The dispensing device according to claim 1, wherein the actuating elements protrude beyond the surrounding housing, so that a peripheral section of the actuating element has a larger distance to the dispensing nozzle than an assigned peripheral section of the housing in the same direction.

* * * * *